US006206232B1

(12) United States Patent
Marini et al.

(10) Patent No.: US 6,206,232 B1
(45) Date of Patent: Mar. 27, 2001

(54) ARTICLE DISPENSER

(75) Inventors: Donald A. Marini, Sonoma, CA (US); Gerald A. Sciarini, Solon, OH (US)

(73) Assignee: Oddzon, Inc., Napa, CA (US)

( * ) Notice: Subject to any disclaimer, the term of this patent is extended or adjusted under 35 U.S.C. 154(b) by 0 days.

(21) Appl. No.: 09/256,544

(22) Filed: Feb. 24, 1999

(51) Int. Cl.[7] ..... A24F 15/04
(52) U.S. Cl. ..... 221/24; 221/201
(58) Field of Search ..... 221/24, 200, 201, 221/204, 192; 198/752.1

(56) References Cited

U.S. PATENT DOCUMENTS

| | | | |
|---|---|---|---|
| 1,859,635 | 5/1932 | Rose . | |
| 2,302,142 | 11/1942 | Pettit | 46/218 |
| 2,973,604 | 3/1961 | Digirolamo et al. | 46/40 |
| 3,038,586 | 6/1962 | Bonanno | 198/33 |
| 3,746,211 | 7/1973 | Burgess | 221/7 |
| 3,747,810 | 7/1973 | Graser | 222/199 |
| 4,145,981 | 3/1979 | Jimenez | 111/76 |
| 4,733,520 | 3/1988 | Rabbi | 53/559 |
| 4,932,559 | 6/1990 | Stein | 221/7 |
| 5,547,113 | 8/1996 | Chen | 222/642 |
| 5,931,338 * | 8/1999 | Hoeting et al. | 221/24 |

FOREIGN PATENT DOCUMENTS

| | | | |
|---|---|---|---|
| 746559 | 3/1933 | (FR) | 20/2 |

* cited by examiner

*Primary Examiner*—Kenneth W. Noland
(74) *Attorney, Agent, or Firm*—Laff, Whitesel & Saret, Ltd.

(57) ABSTRACT

An article dispenser is disclosed for dispensing articles, such as pieces of candy, out a dispensing opening in the dispenser. Articles are stored in a storage chamber inside the dispenser. An inclined flipper plate forms the bottom of storage chamber. A flipper arm is positioned near the bottom edge of flipper plate. An actuator is included for vibrating the flipper plate and flipper arms causing the articles to slide down the flipper plate onto the flipper arms where they are flipped up onto a dispensing slide located above the storage chamber. Articles flipped up onto the dispensing slide are dispensed out of the dispenser through the dispensing opening.

19 Claims, 2 Drawing Sheets

ARTICLE DISPENSER

FIELD OF THE INVENTION

The present invention relates to article dispensers. More particularly, the present invention relates to article dispensers for dispensing articles, such as candy, from a storage chamber located below the dispensing opening.

BACKGROUND INFORMATION

Devices for storing and dispensing articles, such as candy, are well known in the art. Generally, prior art article dispensers include a storage chamber located above a dispensing opening. A retractable door is typically positioned between the bottom of the storage chamber and the dispensing opening. When the door is closed, articles stored in the storage chamber rest against the door. When the door is retracted, gravity forces the articles stored in the storage chamber to drop through the dispensing opening thus dispensing the articles for use by the operator.

One problem with these prior art article dispensers is that articles can become jammed in the opening between the storage chamber and dispensing opening preventing the articles from flowing out of the dispensing opening. Another problem with the prior art article dispensers is that it is difficult to control the amount of articles dispensed.

Thus, there is a need for an improved article dispenser that dispenses articles in a controlled manner preventing article jams and easily allowing the desired amount of articles to be dispensed.

SUMMARY OF THE INVENTION

These needs and other needs are satisfied by an article dispenser according to the present invention, which comprises a storage chamber, a flipping plate, a flipper arm, a dispensing slide and an actuator for causing the flipping plate and flipper arm to vibrate.

The storage chamber is configured for storing articles, such as candy. The flipping plate forms the bottom of the storage chamber. The flipping plate is inclined and articles that are stored in the storage chamber rest upon the flipping plate.

The flipper arm is located near the bottom edge of the flipping plate. The dispensing slide is located adjacent to the flipper arm and above the bottom edge of the flipping plate. A dispensing opening is located at the end of the dispensing slide opposite the flipper arm.

The actuator is configured to cause the flipping plate and the flipper arm to vibrate causing articles stored in the storage chamber to move down the inclined flipping plate onto the flipping arm. The flipping arm flips articles onto the dispensing slide and out the dispensing opening thus dispensing the articles for use by the operator.

In a preferred embodiment, a first cam is connected to the actuator. The actuator causes the first cam to rotate thus causing the flipping plate to vibrate. A spindle connects the actuator to a gear, which is connected to the first cam by an axle. The spindle includes a threaded connection section for connecting the spindle to the gear.

A second cam is connected to the actuator and the flipper arm such that the actuator causes the second cam to rotate thus causing the flipper arm to vibrate. A lever is connected to the flipper arm and the second cam. The axle extends through the gear connecting the second cam to the gear. The second cam periodically contacts the lever connected to the flipper arm causing the flipper arm to vibrate.

Preferably, the flipper arm comprises a primary flipper arm and a plurality of secondary flipper arms. A flipper head is connected to the primary flipper arm and each of the secondary flipper arms.

Upon activation the actuator causes the spindle, the gear, the first cam, the axle, the second cam and the lever to rotate thus causing the flipping plate and primary and secondary flipper arms to vibrate. Articles resting on the flipping plate slide down the flipping plate incline toward the flipper arms due to the vibration of the flipping plate. The flipper heads connected to the secondary flipper arms contact the articles forcing them toward the primary flipper arm. The flipping head on the primary flipper arm flips the articles up onto the dispensing slide causing articles to slide out the dispensing opening one at a time.

In the embodiment shown in the drawings, the article dispenser is in the shape of a toy car. The article dispenser includes an additional storage compartment in the hood compartment of the toy car for storing addition articles.

Further objects, features and advantages of the present invention will become apparent from the following description and drawings.

DETAILED DESCRIPTION OF THE PREFERRED EMBODIMENT

Figure 1:
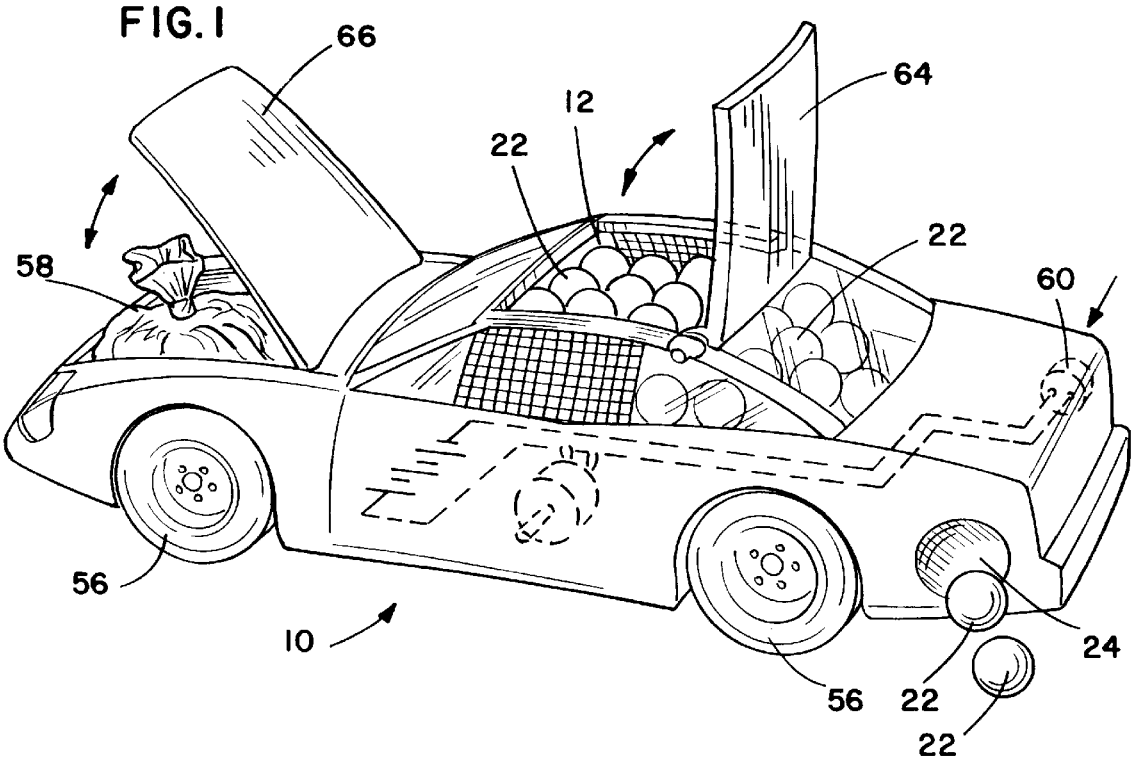
FIG. 1 is a perspective view of an article dispenser according to the present invention.
Figure 2:
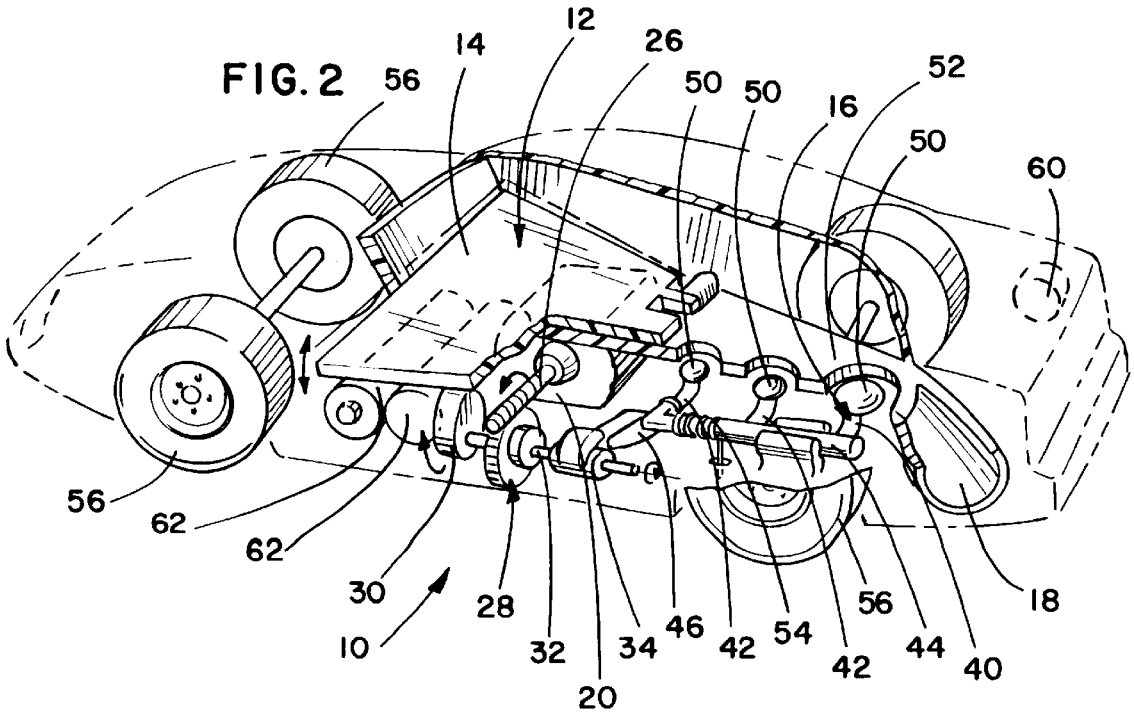
FIG. 2 is a perspective cut-away view showing the internal dispensing system of FIG. 1.
Figure 3:
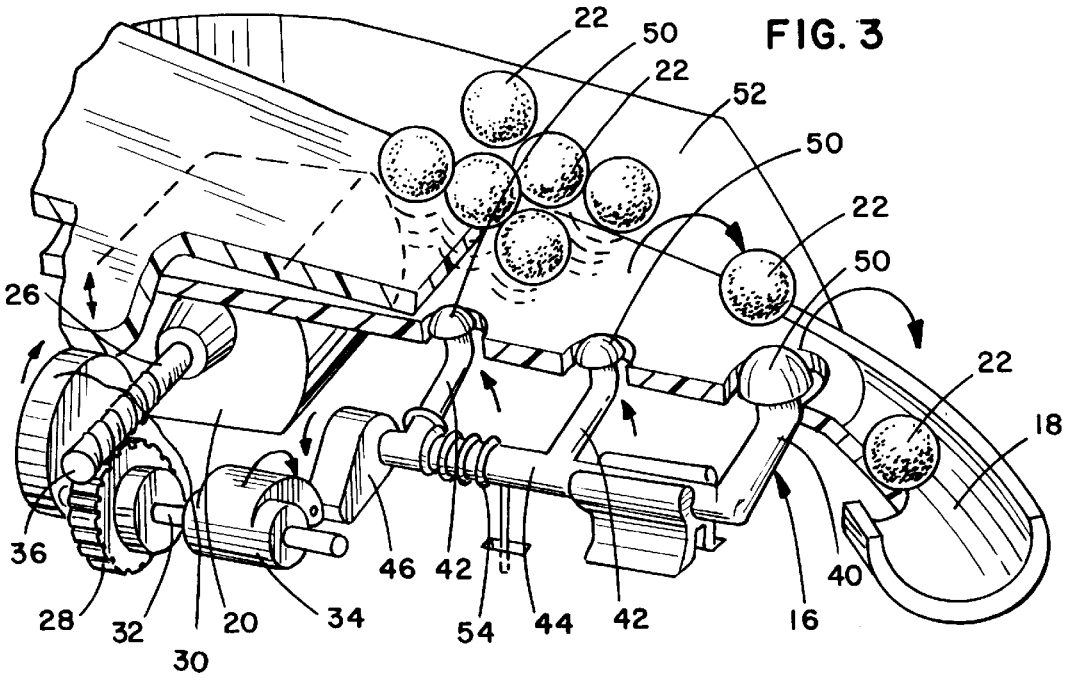
FIG. 3 is an enlarged cut-away view of the flipper arms and dispensing slide of FIG. 2.
Figure 4:
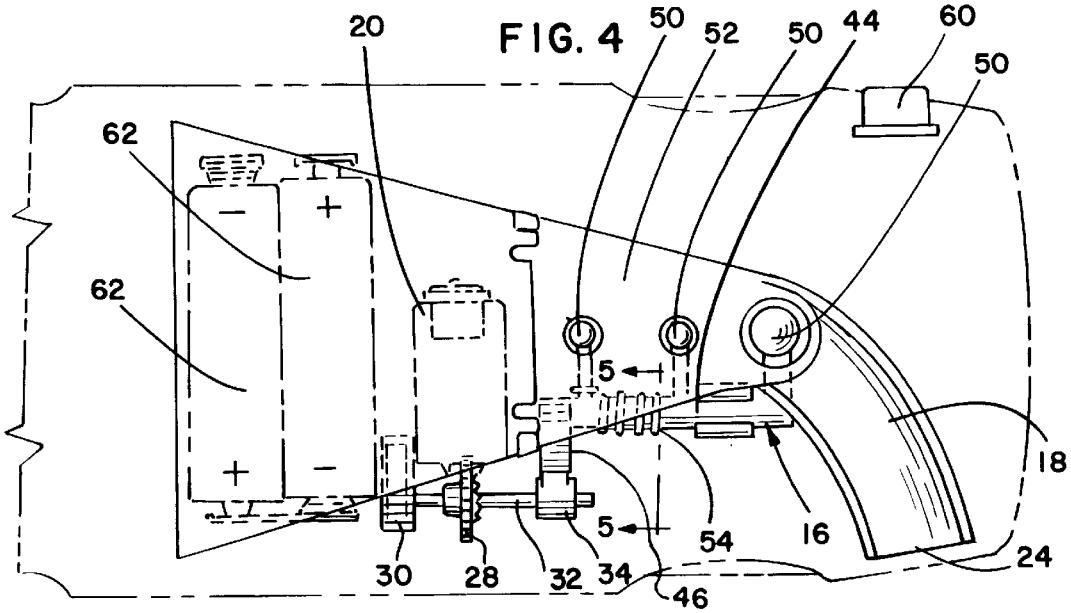
FIG. 4 is a top cut-away view showing the internal dispensing system of FIG. 1.
Figure 5:
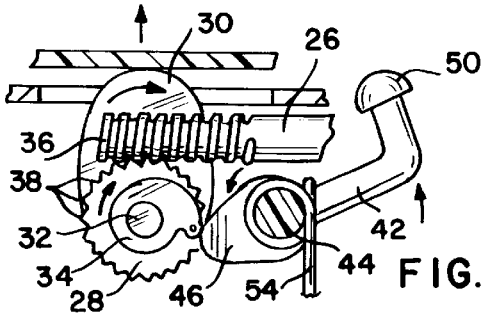
FIG. 5 is an enlarged cross-sectional view showing the lever, second cam and a flipper arm in the projected position of FIG. 4.
Figure 6:
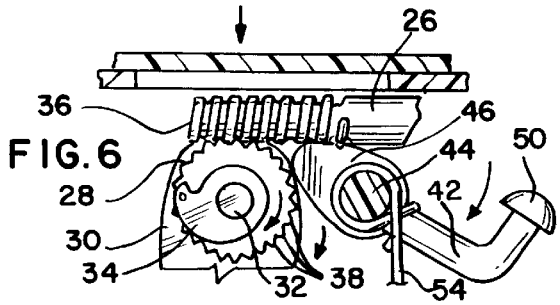
FIG. 6 is an enlarged cross-sectional view showing the lever, second cam and a flipper arm in the retracted position of FIG. 4.

In accordance with the present invention, a candy dispenser is described that provides distinct advantages when compared to those of the prior art. The invention can best be understood with reference to the accompanying drawing figures.

Referring now to the figures, the article dispenser is generally designated by reference numeral 10. The article dispenser 10 comprises a storage chamber 12, a flipping plate 14, a flipper arm 16, a dispensing slide 18 and an actuator 20. The flipping plate 14 forms the bottom of the storage chamber 12. Articles 22 stored in the storage chamber 12 rest on the flipping plate 14.

The flipping plate 14 is positioned at an incline and is secured at its bottom edge by a hinge-type device such that the flipping plate 14 is rotatable around its bottom edge. The flipper arm 16 is located near the bottom edge of the flipping plate 14. The dispensing slide 18 is located adjacent to and above the flipper arm 16 and above the bottom edge of the flipper plate 14. A dispensing opening 24 is located at the end of the dispensing slide 18 opposite the flipper arm 16.

In the preferred embodiment, the actuator 20 comprises a battery-operated electric motor. A spindle 26 connects the actuator 20 to a gear 28. The spindle 26 includes a threaded connection section 36 that mates with teeth 38 on the outer periphery of the gear 28.

A first cam 30 is connected to the gear 28 by an axle 32. The first cam 30 is positioned such that rotation of the gear 28 causes the first cam 30 to rotate about the axle 32 causing the first cam 30 to periodically contact the flipping plate 14. This causes the flipping plate 14 to vibrate. The axle 32 extends through the gear 28 to connect the gear 28 to a second cam 34. Rotation of the gear 28 also causes the second cam 34 to rotate about the axle 32.

In the embodiment shown in the drawings, the flipper arm 16 comprises a primary flipper arm 40 and two secondary flipper arms 42 connected together by a connection arm 44. The primary flipper arm 40 is positioned adjacent to the dispensing slide 18 with the secondary flipper arms 42 positioned in a line between the primary flipper arm 40 and the flipping plate 14.

Flipper heads 50 are connected to the ends of the primary and secondary flipper arms 40, 42. A spring 54 is attached to the connection arm 44 to force the flipper heads 50 to protrude through a bottom plate 52 of the storage chamber 12 in an at rest position.

A lever 46 is connected to the end of the connection arm 44 opposite the primary flipper arm 40. The lever 46 is positioned such that as the second cam 34 rotates, it periodically contacts the lever 46 causing the lever 46 to rotate the connection arm 44. This rotation of the connection arm 44 causes the primary and secondary flipper arms 40, 42 to vibrate up and down.

In the embodiment shown in the drawings, the article dispenser 10 is in the shape of a toy car having four wheels 56. Optionally, the electric motor can also be used to power the wheels of the toy car causing the toy car to move.

The passenger compartment of the toy car acts as the storage chamber 12. The roof section of the passenger compartment is configured as a loading door 64 for the storage chamber 12. The loading door 64 is rotatable around a hinge-type connection located on the back edge of the roof section. Candy, or other articles, are placed in the dispenser 10 by opening the loading door 64 to expose the storage chamber 12.

The engine compartment of the toy car acts as an additional storage compartment 58 for storing extra bags of candy. The hood section of the toy car is configured as a second loading door 66 for the additional storage compartment 58. The second loading door 66 is rotatable around a hinge-type connection located at the back edge of the hood section. Additional bags of candy, or other articles, are placed in the additional storage compartment 58 by opening the second loading door 66 to expose the additional storage compartment 58. In the preferred embodiment, articles stored in the additional storage compartment 58 must be removed and placed in the storage chamber 12 in order to be dispensed through the dispensing opening 24.

In operation, articles 22, such as pieces of candy, are loaded into the storage chamber 12 through the loading door. Articles 22 held in the storage chamber 12 rest against the flipping plate 14.

The actuator 20 is activated by a switch 60 positioned on the exterior of the article dispenser 10. Preferably, the actuator 20 is powered by a pair of 1.5 V, AA batteries 62. Activation of the actuator 20 causes the spindle 26 to rotate. The threads on the threaded connection section 36 of the spindle 26 mate with the teeth 38 on the gear 28 causing the gear 28 to rotate. Rotation of the gear 28 causes the axle 32 to rotate, which in turn causes the first and second cams 30, 34 to rotate.

As the first cam 30 rotates, it periodically contacts the underside of the flipping plate 14 causing the flipping plate 14 to vibrate. This causes articles 22 resting against the flipping plate 14 to slide down the incline toward the bottom edge of the flipping plate 14 and onto the flipping heads 50 attached to the secondary flipper arms 42.

Simultaneously, as the second cam 34 rotates, it periodically contacts the lever 46 connected to the connection arm 44 causing the primary and secondary flipper arms 40, 44 to vibrate. When the second cam 34 contacts the lever 46, it forces the connection arm 44 to rotate expanding the spring 54 and causing the flipper heads 50 to be withdrawn from holes in the bottom plate 52 of the storage chamber 12 into a retracted position. When the second cam 34 rotates out of contact with the lever 46, forces created by the expansion of the spring 54 cause the connection arm 44 to rotate back to its at rest position causing the flipper heads 50 to snap back through the holes in the bottom plate 52 into a projected position.

When the flipper heads 50 snap back through the holes in the bottom plate 52, they strike articles 22 that have slid down the flipping plate 14 into the area of the primary and secondary flipper arms 40, 42. Typically, articles 22 are moved from the secondary flipper arm 42 closest to the flipper plate 14, to the middle secondary flipper arm 42, to the primary flipper arm 40. The primary flipper arm 40 flips articles up onto the dispensing slide 18 causing them to slide out of the dispensing opening 24.

In this manner, articles 22 are dispensed one at a time out of the dispensing opening 24 as long as the switch 60 is activating the actuator 20. Because articles 22 are dispensed one at a time, they do not jam up on the dispensing slide 18 or in the dispensing opening 24. This also provides a method of dispensing articles in which the amount of articles 22 dispensed can be easily controlled. Furthermore, because the storage chamber 12 is located below the dispensing slide 18, articles 22 are prevented from accidentally falling out of the dispenser 10.

It will be apparent to those skilled in the art that modifications may be made without departing from the spirit and scope of the invention. Accordingly, it is not intended that the invention be limited except as may be necessary in view of the appended claims.

What is claimed is:

1. An article dispenser for storing and dispensing articles, said article dispenser comprising:

a storage chamber for storing articles, said storage chamber having a bottom;

a flipping plate which forms said bottom of said storage chamber, said flipping plate having a top edge and a bottom edge and being inclined, wherein said articles rest upon said flipping plate when held in said storage chamber;

a flipper arm located near said bottom edge of said flipping plate;

a dispensing slide located adjacent said flipper arm and above said storage chamber bottom;

a dispensing opening at one end of said dispensing slide opposite said flipper arm; and a switch activated electric motor operated actuator for causing said flipping plate and said flipper arm to vibrate further causing articles resting on said flipping plate to slide down and off said inclined flipping plate onto said flipping arm which flips said article up onto said dispensing slide for movement out said dispensing opening.

2. The article dispenser of claim 1 wherein said article dispenser is a toy car.

3. The article dispenser of claim 1 further comprising an additional storage compartment for storing additional articles.

4. The article dispenser of claim 1 wherein said flipper arm further comprises a primary flipper arm and a plurality of secondary flipper arms.

5. The article dispenser of claim 4 further comprising a flipper head operably connected to said primary flipper arm and to each of said secondary flipper arms.

6. An article dispenser for storing and dispensing articles, said article dispenser comprising;

a storage chamber for storing articles, said storage chamber having a bottom;

a flipping plate which forms said bottom of said storage chamber, said flipping plate having a top edge and a bottom edge and being inclined, wherein said articles rest upon said flipping plate when held in said storage chamber;

a flipper arm located near said bottom edge of said flipping plate;

a dispensing slide located adjacent said flipper arm and above said storage chamber bottom;

a dispensing opening at one end of said dispensing slide opposite said flipper arm;

an actuator for causing said flipping plate and said flipper arm to vibrate further causing articles resting on said flipping to slide down said inclined flipping plate onto said flipping arm which flips said article up onto said dispensing slide and out said dispensing opening; and a first cam operably connected to said actuator and said flipping plate, wherein said actuator causes said first cam to rotate thus causing said flipping plate to vibrate.

7. The article dispenser of claim 6 further comprising a spindle operably connected to said actuator and a gear operably connected to said spindle and said first cam.

8. The article dispenser of claim 6 further comprising:

a second cam operably connected to said actuator and said flipper arm, wherein said actuator causes said second cam to rotate thus causing said flipper arm to vibrate.

9. The article dispenser of claim 8 further comprising a lever operably connected to said flipper arm and said second cam.

10. The article dispenser of claim 7 wherein said spindle further comprises a threaded connection section for connecting said spindle to said gear.

11. An article dispenser for storing and dispensing articles, said article dispenser comprising;

a storage chamber for storing articles, said storage chamber having a bottom;

a flipping plate which forms said bottom of said storage chamber, said flipping plate having a top edge and a bottom edge and being inclined, wherein said articles rest upon said flipping plate when held in said storage chamber;

a flipper arm located near said bottom edge of said flipping plate;

a dispensing slide located adjacent said flipper arm and above said storage chamber bottom;

a dispensing opening at one end of said dispensing slide opposite said flipper arm;

an actuator for causing said flipping plate and said flipper arm to vibrate further causing articles resting on said flipping to slide down said inclined flipping plate onto said flipping arm which flips said article up onto said dispensing slide and out said dispensing opening; and a spindle operably connected to said actuator;

a gear operably connected to said spindle;

a first cam operably connected to said gear and said flipping plate;

a second cam operably connected to said gear;

a lever operably connected to said second cam and said flipper arm;

wherein said actuator causes said spindle, said gear, said first cam, said second cam and said lever to rotate thus causing said flipping plate and flipper arm to vibrate.

12. A candy dispenser for storing and dispensing pieces of candy, said candy dispenser comprising:

a storage chamber for storing said pieces of candy;

a flipping plate forming a bottom of said storage chamber;

a flipper arm located adjacent said flipping plate;

a dispensing slide in cooperation with an opening in said candy dispenser, said dispensing slide being located adjacent to said flipper arm and above said storage chamber;

an electric motor operably connected to said flipping plate by a hear and a first cam, said motor further operably connected to said flipper arm by said gear, a second cam and a lever;

a switch for activating said electric motor, said activated electric motor causing said gear and first cam to rotate thus causing said flipping plate to vibrate so pieces of candy slide toward and make contact with said flipper arm, said activated electric motor also causing said second cam and lever to rotate, which causes said flipper arm to vibrate thereby flipping the pieces of candy onto the dispensing slide, whereupon the pieces of candy slide out of said opening in said candy dispenser.

13. The candy dispenser of claim 12 further comprising a spindle operably connection said electric motor to said gear.

14. The candy dispenser of claim 13 wherein said spindle further comprises a threaded connection section for connecting said spindle to said gear.

15. The candy dispenser of claim 12 further comprising an axle operably connecting said gear to said first cam and said second cam;

wherein rotation of said gear causes said axle, said first cam and said second cam lever to rotate thus causing said flipper arm to vibrate.

16. The candy dispenser of claim 12 wherein said candy dispenser is a toy car.

17. The candy dispenser of claim 12 further comprising an additional storage compartment for storing addition pieces of candy.

18. The candy dispenser of claim 12 wherein said flipper arm further comprises a primary flipper arm and a plurality of secondary flipper arms.

19. The candy dispenser of claim 18 further comprising a flipper head operably connected to said primary flipper arm and each of said secondary flipper arms.

* * * * *